US008959849B1

(12) United States Patent
DiGirolamo et al.

(10) Patent No.: US 8,959,849 B1
(45) Date of Patent: Feb. 24, 2015

(54) LIGHT STEEL FRAME STRUCTURE FOR DECK

(75) Inventors: Edward R. DiGirolamo, Raleigh, NC (US); Charles DiGirolamo, Hockessin, DE (US)

(73) Assignee: The Steel Network, Inc., Raleigh, NC (US)

( * ) Notice: Subject to any disclaimer, the term of this patent is extended or adjusted under 35 U.S.C. 154(b) by 1892 days.

(21) Appl. No.: 11/944,046

(22) Filed: Nov. 21, 2007

(51) Int. Cl.
*E04F 11/00* (2006.01)
*E04F 11/025* (2006.01)
*E04B 5/10* (2006.01)

(52) U.S. Cl.
USPC ..... 52/182; 52/263; 52/289; 52/655.1; 52/702; 52/715

(58) Field of Classification Search
USPC ..... 256/65.14; 403/DIG. 15, 232.1; 428/603, 569; 52/182, 184, 188, 191, 52/263, 289, 483.1, 655.1, 698, 702, 715, 52/834
See application file for complete search history.

(56) References Cited

U.S. PATENT DOCUMENTS 666,918 A * 1/1901 Butz ..... 403/190
1,412,406 A * 4/1922 Hodgson ..... 52/179
1,833,043 A * 11/1931 Sheldon ..... 72/368
2,321,221 A * 6/1943 Linehan ..... 403/230
2,545,147 A * 3/1951 Jensen ..... 248/259
3,927,518 A * 12/1975 Simmons et al. ..... 52/183
4,019,301 A * 4/1977 Fox ..... 52/834
4,464,074 A * 8/1984 Green et al. ..... 403/192
4,688,358 A * 8/1987 Madray ..... 52/93.2
4,706,426 A * 11/1987 Rumsey ..... 52/232
4,717,279 A * 1/1988 Commins ..... 403/187
4,759,162 A * 7/1988 Wyse ..... 52/126.6
5,259,685 A * 11/1993 Gilb ..... 403/231
5,333,887 A 8/1994 Luther
5,771,655 A * 6/1998 Strickland et al. ..... 52/745.2
5,809,906 A * 9/1998 Janek ..... 108/57.15
6,158,188 A * 12/2000 Shahnazarian ..... 52/702
6,415,581 B1 * 7/2002 Shipman et al. ..... 52/798.1
6,660,938 B2 * 12/2003 Herb et al. ..... 174/68.1
6,691,478 B2 * 2/2004 Daudet et al. ..... 52/289
6,763,912 B2 * 7/2004 Robinson et al. ..... 182/115
7,048,462 B2 * 5/2006 Lanphier ..... 403/188
7,461,481 B2 * 12/2008 Tsai ..... 52/167.3
7,707,785 B2 * 5/2010 Lin ..... 52/92.2
2006/0016139 A1 * 1/2006 Beck et al. ..... 52/289

FOREIGN PATENT DOCUMENTS

WO WO 9304612 A1 * 3/1993 ..... A47B 57/56

* cited by examiner

*Primary Examiner* — Charles A Fox
*Assistant Examiner* — Joseph J Sadlon
(74) *Attorney, Agent, or Firm* — Coats and Bennett PLLC

(57) ABSTRACT

A metal deck kit for erecting a metal deck appurtenant a residential structure. The kit includes a plurality of metal components including support posts, girders, joists, bridging elements, rim tracks, ledgers, along with various connectors, stiffeners, adapters, and brackets for connecting the components together to form a metal deck. Vibration or shock absorbing pads are included for use between various components to reduce shock and vibration transmission through portions of the metal deck. A method of forming a metal deck using these components is also provided.

17 Claims, 11 Drawing Sheets

LIGHT STEEL FRAME STRUCTURE FOR DECK

FIELD OF THE INVENTION

The present invention relates to the field of residential deck construction and more particularly to light steel frame construction of residential decks.

BACKGROUND

Residential decks comprise one of the more popular features of homes. Such decks are commonly connected to residences and provide outdoor living space for residents of homes and their guests. The may be entirely open, covered by roofs, or enclosed by screens or other walls.

Decks are typically constructed of wood that has been treated to prevent decay and insect damage. Generally, 4"×4" or larger treated wooden posts are supported on concrete footings and support a treated wood-framed platform. The platform is commonly formed from an array of wooden joists, bridging, outer bands and ledgers connected together and supported on one or more girders that rest on the wooden posts. Planks comprising treated wood are commonly secured to the platform to provide the finished surface. Wooden handrails are sometimes employed about portions of the deck, and wooden stairs or steps are commonly used to provide ingress and egress for the deck.

While treated wood is durable, regular cleaning and waterproofing is generally needed for appearance purposes, at least. In some cases, recycled polymer-based or other man-made decking materials are used. These materials do not generally require waterproofing. Frequent cleaning may not be required because mold and mildew, for example, do not tend to feed on the polymeric material. However, such man-made materials, particularly the polymer-based materials, are known to sometimes exhibit localized swelling and unsightly "blousing" of fibers near holes where fasteners are inserted through visible surfaces of the polymer-based planks. This is true even when the holes are countersunk or counter-bored. Splitting and distortion may occur in treated wood posts and girders, for example, and may sometimes require replacement of posts or other elements of the wooden deck.

Deck structures of more durable and stable materials would alleviate some of the aforementioned problems that occur with wooden decks.

SUMMARY

The present invention provides a metal deck kit for erecting a metal deck appurtenant a residential structure. The kit comprises a plurality of metal joists, one or more metal rim tracks, and a plurality of connectors for forming a platform. One or more metal girders are included for supporting the platform. To support the girders, one or more support posts are also provided. The kit may also include one or more sets of metal stairs for connecting to the platform and for providing ingress and egress from the deck.

The present invention further provides a method of erecting a metal deck for a residential structure. The method includes securing one or more metal posts to a ground area adjacent the residential structure. Also, the method includes securing one or more metal girders about upper portions of the one or more posts. The method further includes horizontally extending one or more metal joists across the one or more girders and securing the joists to the girder or girders such that the joists are in a spaced apart array forming a platform for receiving decking. Extending one or more rim tracks along a periphery of the platform is also included along with connecting the rim tracks to the joists. The method provides for connecting a metal handrail assembly about a portion of the periphery of the platform. Connecting at least one set of stairs to the platform is included in the method, where each set of stairs comprises a pair of spaced-apart stringers each having a series of support cleats secured thereto and a series of tread pans disposed between the stringers, and wherein opposite ends of the tread pans are supported by the support cleats.

DETAILED DESCRIPTION

Figure 1:
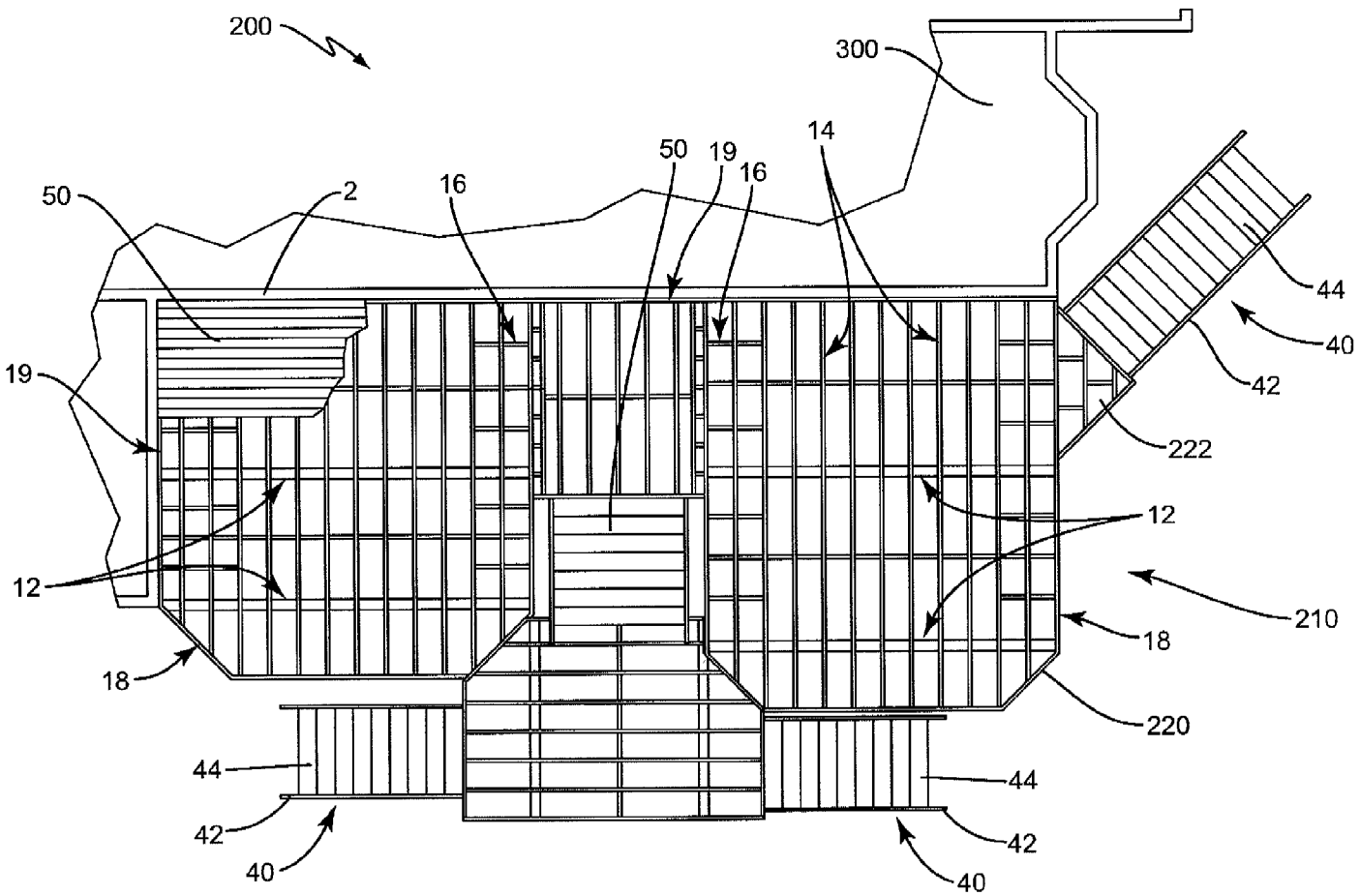
FIG. 1 is a plan view of a metal deck erected adjacent a residential structure.
Figure 1A:
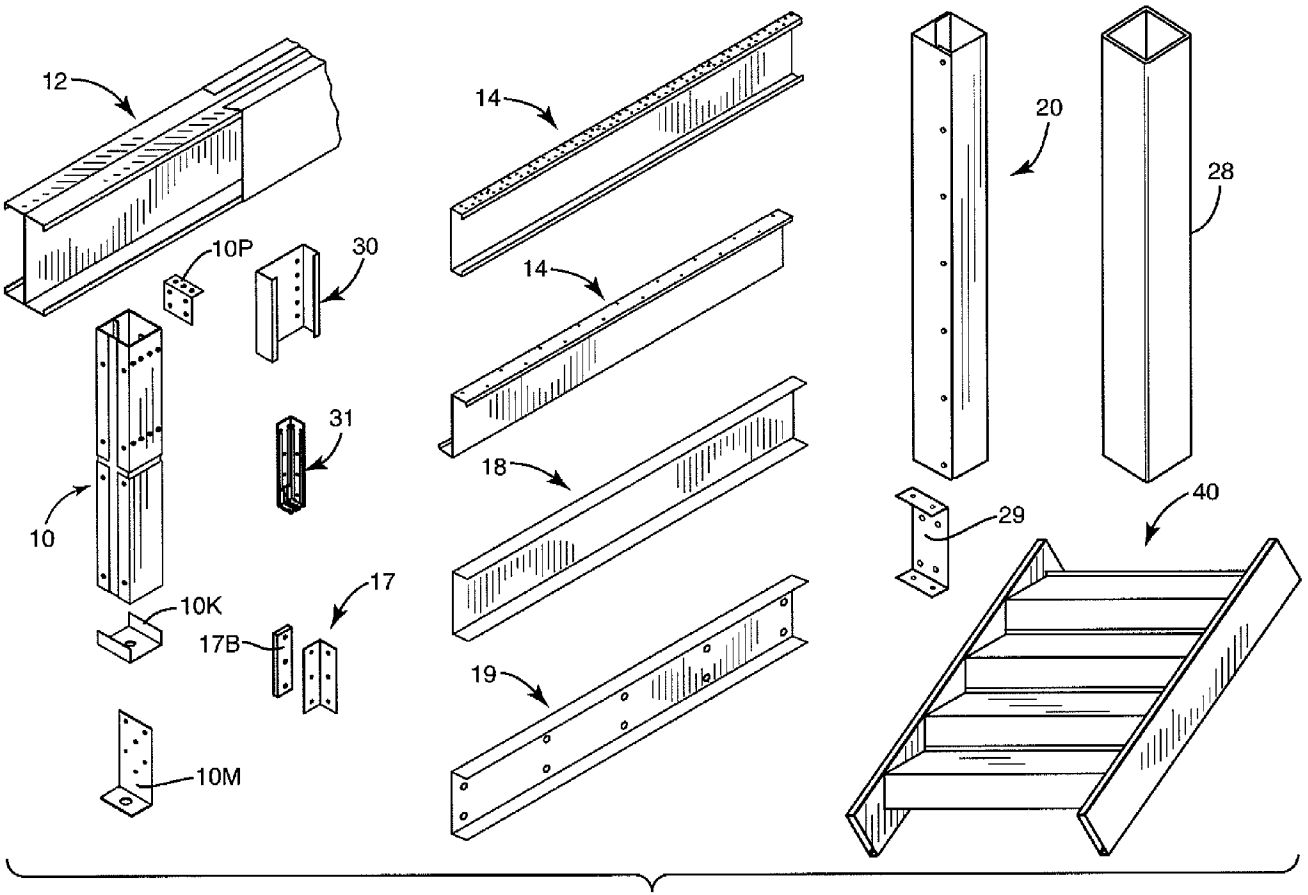
FIG. 1A is a combined view of the components comprising the kit.

With further reference to the drawings, the present invention relates a kit 100 comprising components for erecting a metal deck appurtenant to a residential structure 300. The deck, illustrated generally by the numeral 200 in FIG. 1, includes a metal platform 210 supported on a metal support structure and one or more sets of metal stairs 40 Optionally one or more metal handrail posts 20 may be included for forming a part of a handrail assembly. See FIG. 4. Kit 100 includes an array of metallic and non-metallic components for use in erecting deck 200 as illustrated in FIG. 1A. Each component will be described hereinafter in detail.

Platform 210 includes a plurality of spaced-apart metal joists 14 oriented generally parallel to each other and forming the platform as a generally horizontal structure. Disposed about the perimeter of the platform 210 are one or more metal rim tracks 18 that provide a generally smooth or uniform perimeter or edge. Where deck 200 is connected to residential structure 300 there may be disposed there between one or more metal ledgers 19 connecting platform 210 to the residential structure. Metal bridging elements 16 are incorporated into the platform 210. At selected locations, the metal bridging elements 16 extend between adjacent joists 14 or between a rim track 18 or ledger 19 and an adjacent joist. A variety of other components including metallic connectors 17 and stiffeners 30, 31 are included for use in forming the platform 210 and will be discussed further below. Customer supplied decking 50 may be applied to platform 210 as illustrated in FIG. 1.

The support structure for platform 210 includes one or more metal girders 12 and a series of metal posts 10. Each post 10 is generally supported on a footing 1 and anchored to the footing. See FIG. 2. Each girder 12 is generally supported on at least two support posts 10, and in many cases platform 210 is supported generally on at least two girders. One of the girders 12 may be supported by posts 10 at either end of the girder. In some cases one or both ends of girder 12 may be cantilevered beyond one of the support posts 10. A support post 10 may be connected directly to a portion of platform 210 to provide support for a platform extension or landing such as the stair landing 222 depicted in FIG. 1. A number of additional metal components including mounting clips and brackets are included for use in forming the support structure and will be discussed further below.

In some cases, residential structure 300 may form part of the support structure for platform 210. As mentioned before, one or more metal ledgers 19 may be interposed between platform 210 and residential structure 300. Typically, each ledger 19 is adapted to be secured to a band 2, or other structural element of residential structure 300. Ledger 19 is further adapted to receive ends of joists 14, stiffener 31, or bridging 16 and to provide support thereto. See FIG. 2.

One or more sets of metal stairs 40 may be connected to platform 210 to provide ingress and egress for deck 200. Each set of stairs 40 includes a pair of stringers 42 and a series of tread pans 44 that form steps. Each set of stairs 40 may be connected to a portion of the platform 210. For example, set of stairs 40 may be connected to rim track 18 adjacent stair landing 222 as illustrated in FIG. 1. Extending from platform 210 to the surrounding ground, each set of stairs 40 is also partially supported on the ground or by a finished surface such as concrete.

Where required by safety codes or otherwise desired, kit 100 may include metal handrail posts 20 for forming handrail assemblies about portions of deck 200. These posts can be sized such that a standard composite sleeve may be slid over them for decorative purposes. See FIG. 4. It is appreciated that handrail assemblies may be required or desired along portions of the perimeter of platform 210, along stair stringers 42, and about any openings such as may be formed in platform 210 for trees, fountains, and etc.

Figure 7A:
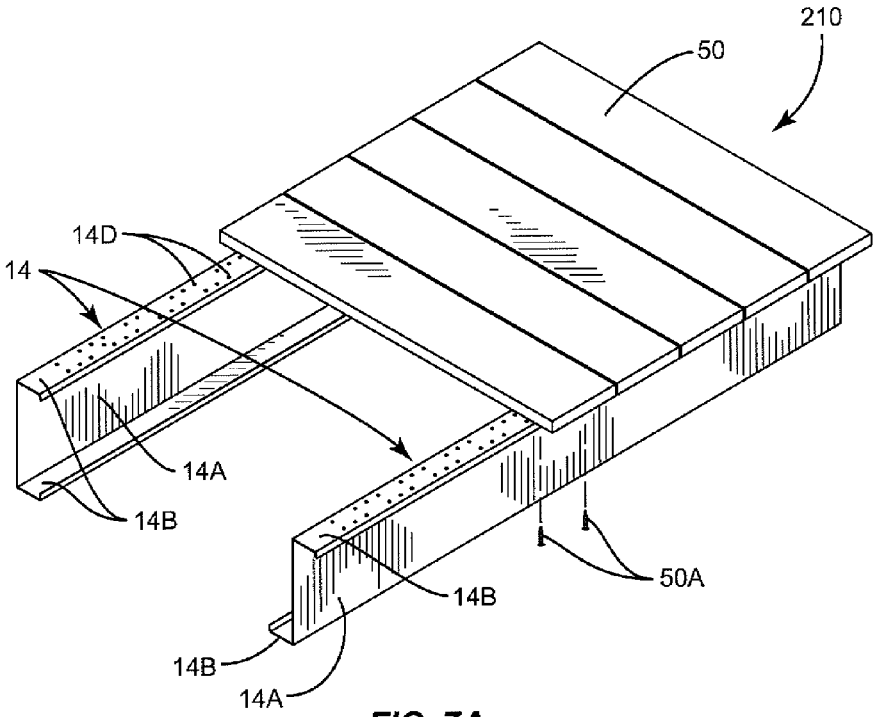
FIG. 7A is a fragmentary perspective view of the metal deck platform with non-metallic plank decking applied thereto according to one embodiment.
Figure 7B:
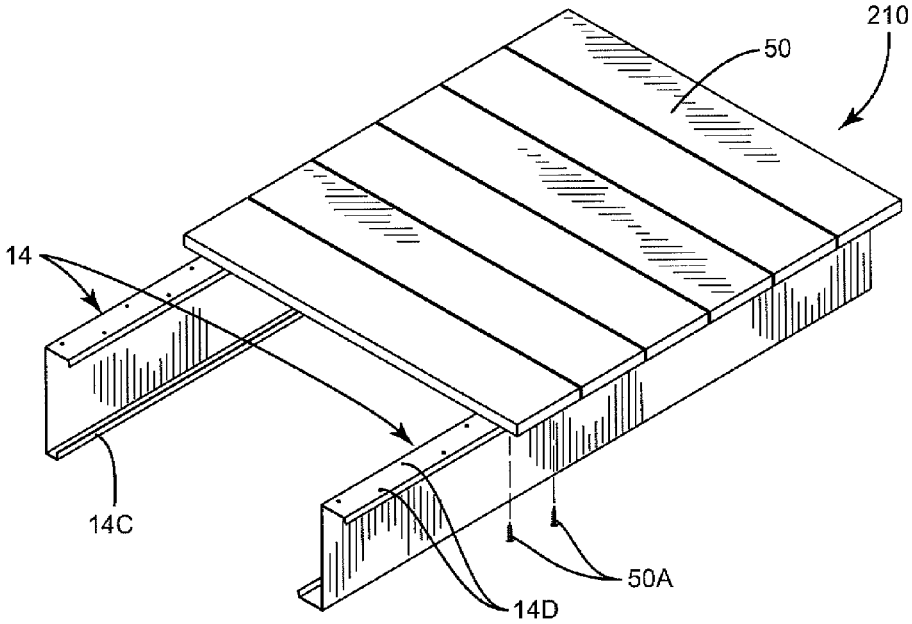
FIG. 7B is a fragmentary perspective view of the metal deck platform with non-metallic plank decking applied thereto according to an alternate embodiment.

Moving now to a detailed description of the components of kit 100 for forming platform 210, as noted before the kit includes a plurality of metal joists 14. In one embodiment, each joist 14 comprises an elongated channel having a web 14A and a pair of flanges 14B extending in the same general direction at an angle typically of about 90 degrees relative to the web. Extending along an edge of each flange 14B is a flange lip 14C. Lip 14C extends at an angle from flange 14B, the angle typically about 90 degrees. Another embodiment includes joists 14 formed as "Z" sections as illustrated in FIGS. 1A, 7A, and 7B. In this embodiment, the flanges 14B extend from web 14A generally in opposite directions. In one design, the top flanges of the joists 14 include an array of pre-punched holes 14D for facilitating the attachment of planks or decking. See FIGS. 7A and 7B.

Figure 4:
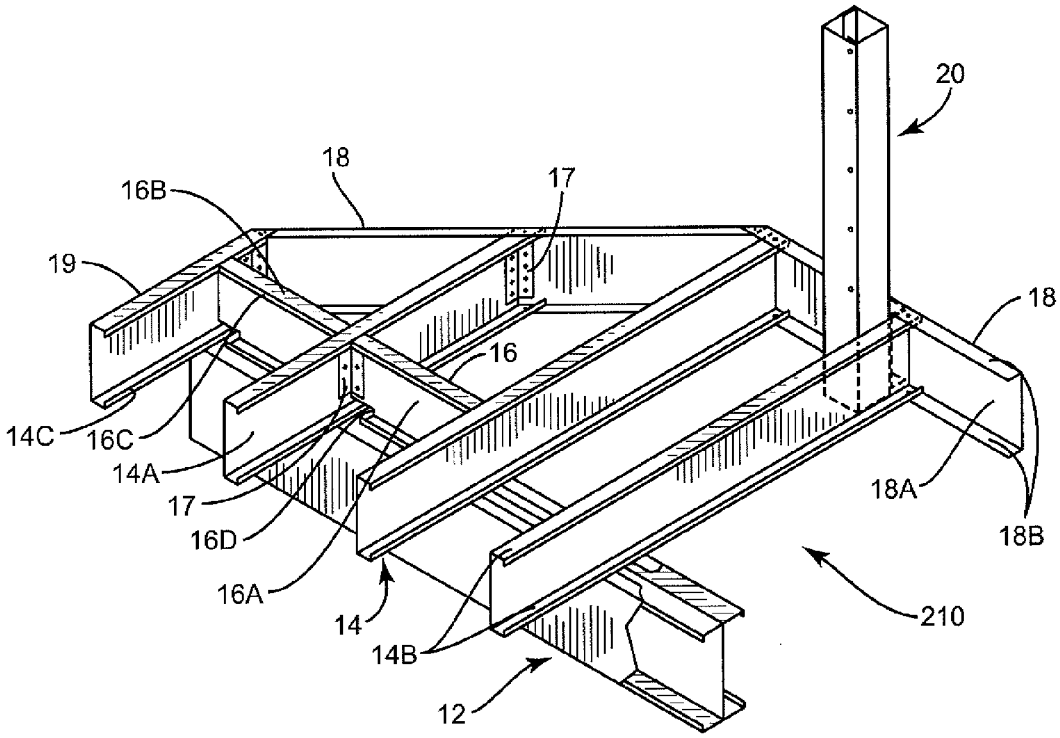
FIG. 4 is a fragmentary perspective view of a metal deck showing bridging elements and a rim track connected to a plurality of joists.

As noted above, bridging elements 16 are provided for connecting between adjacent joists 14 and between the joists and other elements such as rim tracks 18. Bridging elements 16 are typically channel-type sections of similar conformation as joists 14. Bridging elements 16 may be cut to length to fit between adjacent joists 14 when forming platform 210. In one embodiment, each bridging element 16 includes a bridging web 16A and a pair of bridging flanges 16B, both extending generally perpendicularly from the web in the same direction as shown in FIG. 4. Each flange 16B may include a lip 16C extending along the length of the flange and angled approximately 90 degrees relative to the flange. In one embodiment, the height of bridging element 16 is somewhat less than the height of joist 14 such that the flanges 16B may extend between flanges 14B when the bridging element is engaged with the joist.

In one embodiment the height of bridging element 16 is approximately the same as the height of joist 14, in which case one or more flange cutouts 16D may be provided at end portions of the flanges 16B to facilitate engagement of the bridging element with the joist as shown in FIG. 4. In one embodiment, connectors 17, each comprising a bent plate, are provided for use as also shown in FIG. 4. Connectors 17 include openings 17A for receiving fasteners. The angle at which each connector 17 is bent may be varied depending on the location at which the connector is to be applied. Connectors 17 may be utilized, for example, for securing bridging elements 16 to joists 14 and rim tracks 18 as well as for interconnecting other components as will be discussed below.

For use in association with connectors 17 as well as in other cases where one component is joined to another in deck 200, kit 100 may include a plurality of shock or vibration absorbing pads 17B. See FIGS. 1A and 10. Pad 17B comprises a generally compliant sheet or slab that may be of various shapes appropriate for a particular connector 17 or suitable for other connections in deck 200. In one embodiment, pad 17B comprises a high density rubber or man-made compliant material. The compliant material has sufficient strength to withstand loading encountered in deck 200 as well as sufficient energy absorption capacity to prevent or reduce transmission of shock or vibration across connections in the deck.

Figure 2:
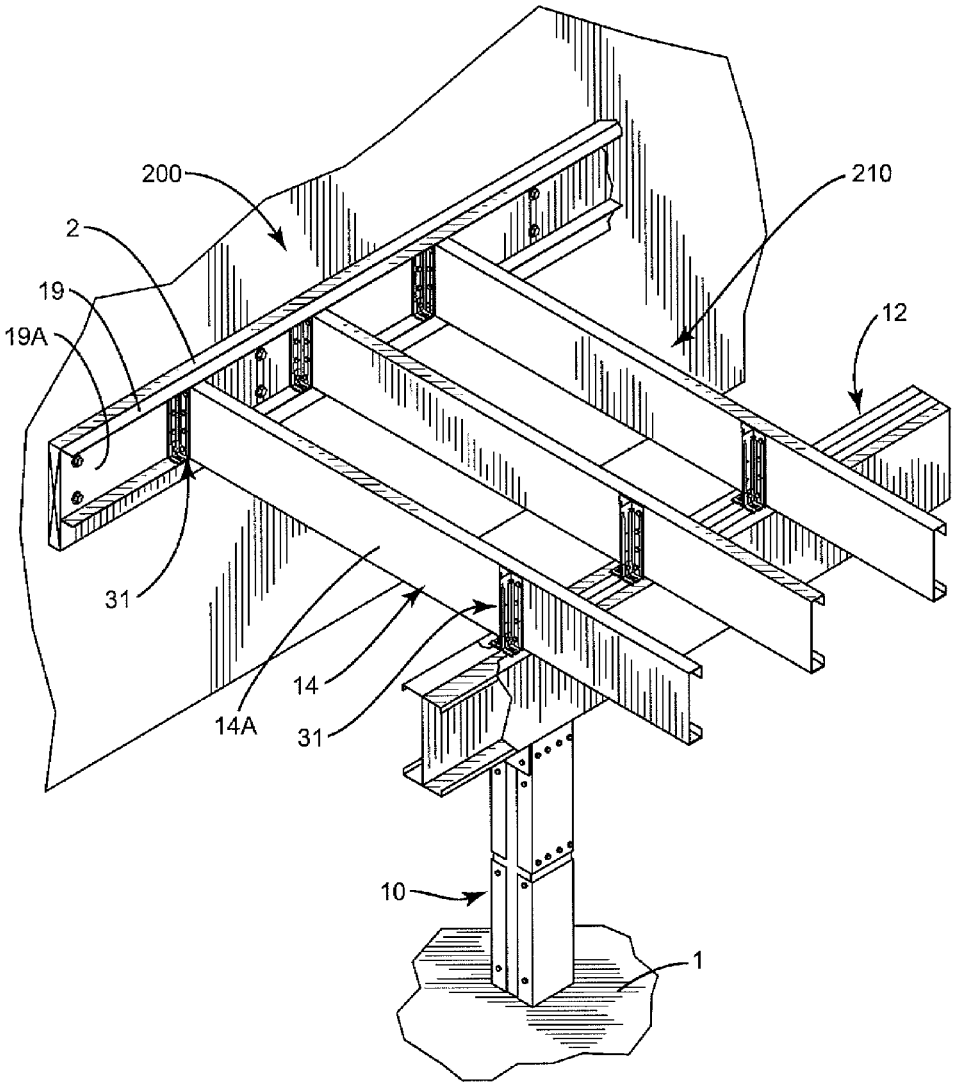
FIG. 2 is a fragmentary perspective view of a metal deck showing a portion of the platform partially supported on a post and girder and attached to a portion of the residential structure.
Figure 3:
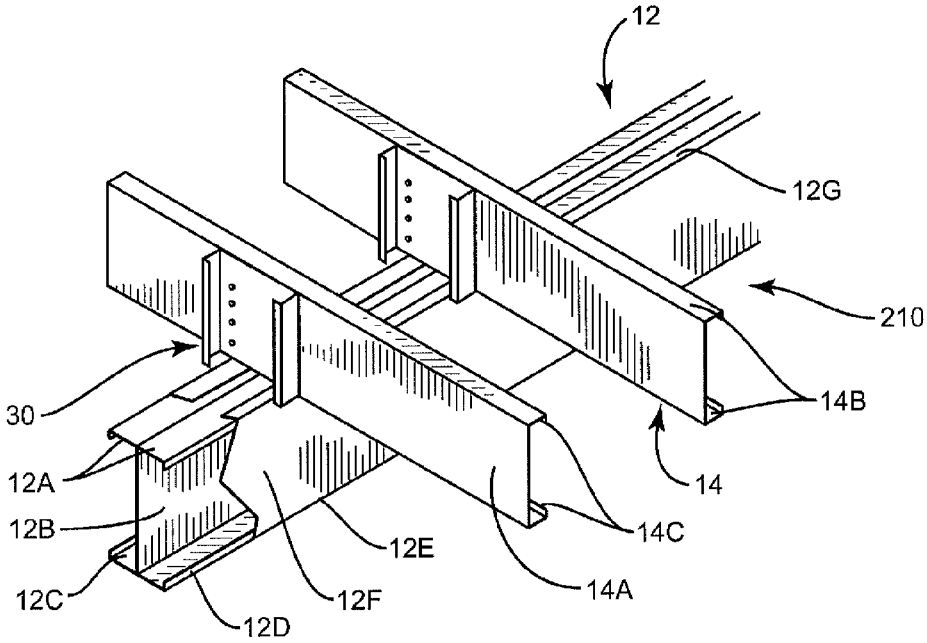
FIG. 3 is a fragmentary perspective view of a metal deck showing one embodiment of a girder and showing a channel-type web stiffener connecting a joist to a girder and stiffening the joist web.
Figure 5A:
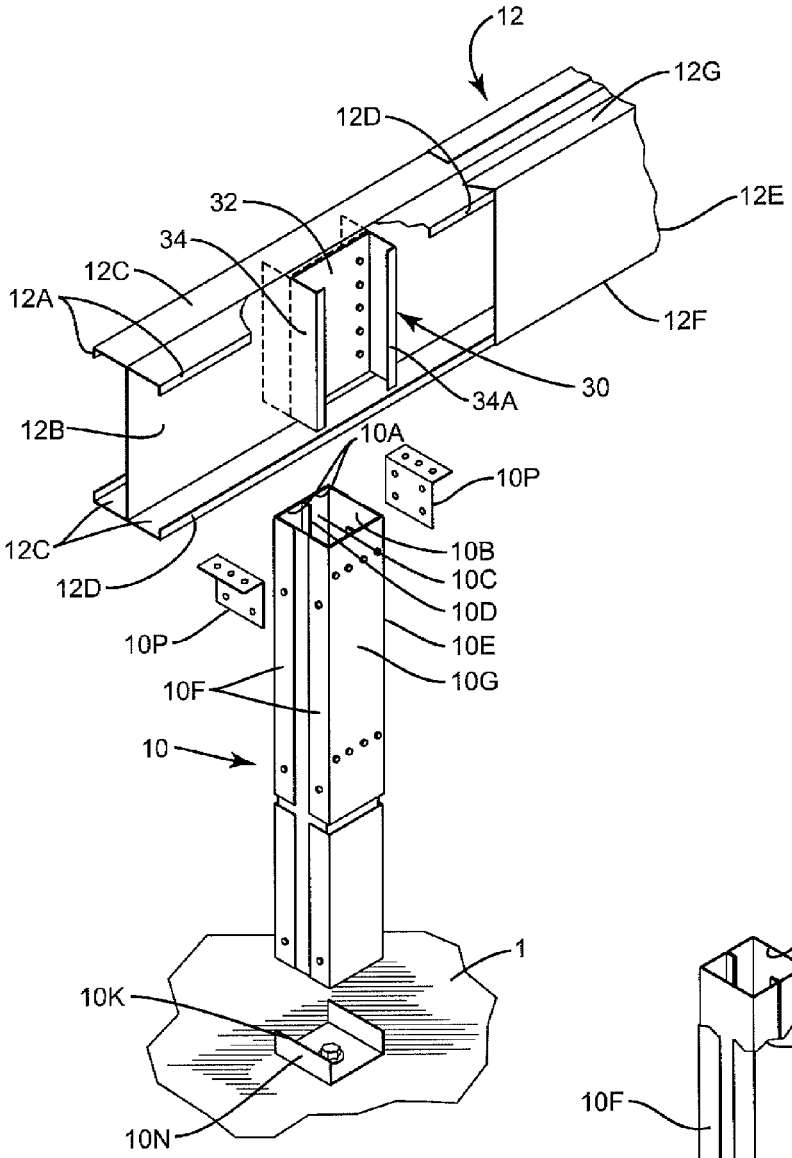
FIG. 5A is an exploded fragmentary perspective showing a support post and girder.
Figure 6:
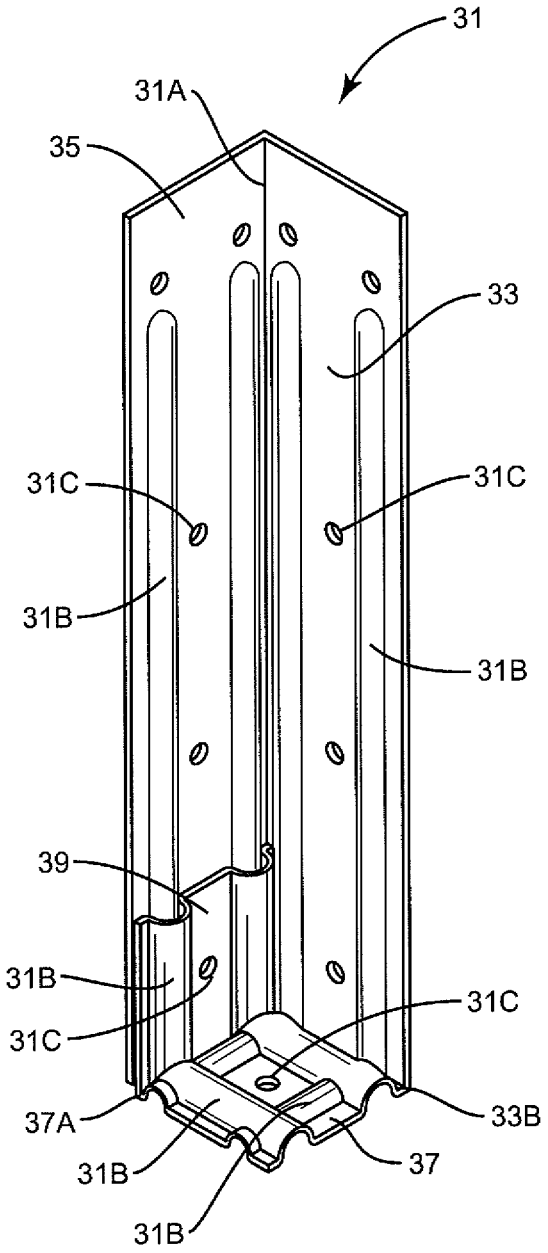
FIG. 6 is a perspective view of an angle-type web stiffener.

A plurality of angle-type web stiffeners 31 are provided for use in stiffening joist webs 14A as illustrated in FIG. 2. Each web stiffener 31 comprises an elongated metal plate bent about a longitudinal axis to form an edge 31A between a first elongated flange 33 and a second elongated flange 35. See FIG. 6. The angle between flanges 33, 35 is typically about 90 degrees. First elongated flange 33 includes a main tab 37 extending from an end of the flange and bent about a first axis 33B at an angle, typically 90 degrees, with respect to the flange. Main tab 37 includes a secondary tab 39 extending from the main tab and bent about a second axis 37A. Secondary tab 39 is generally normal to transverse axis 33B, being bent such that it extends adjacent a portion of flange 35. Stiffener 31 includes an array of stiffening ribs 31B formed in flanges 33 and 35, main tab 37, and secondary tab 39. Reinforcing or stiffening ribs 31B are formed in secondary tab 39 and so placed that, when the secondary tab extends adjacent second flange 35, the stiffening ribs formed in the secondary tab align with and engage portions of the stiffening ribs formed in second flange 35. An array of openings 31C for receiving fasteners is likewise formed in flanges 33, 35, main tab 37, and secondary tab 39. Some of the openings 31C formed in secondary tab 39 are placed such that the openings in the secondary tab align with some of the openings formed in second flange 35. Thus formed, web stiffener 31 is configured as an open box-type structure having ribbed first and second flanges 33, 35 that are angled with respect to each other and a ribbed end section formed by main tab 37. Alternatively or in addition to web stiffeners 31, a further plurality of channel-type web stiffeners 30 may be provided for use as web stiffeners for joists 14 as illustrated in FIGS. 3 and 5A. Web stiffeners 30, 31 may be also be utilized, for example, to stiffen or reinforce joists 14, girders 12, or rim tracks 18. Additionally, web stiffeners 30, 31 may be utilized to form connections between various members as an alternative to connector 17, especially in places where stiffening or reinforcing of one of the members is required.

The one or more rim channels 18 and ledgers 19 included in kit 100 are each generally channel-shaped elongated elements. See FIG. 4. Each rim track 18 comprises a channel section having a web 18A and a pair of flanges 18B. The height of web 18A, as measured from one of the flanges 18B to the other, is typically such that ends of joists 14 may be received between the flanges. The ends of the joists 14 may be secured to the rim channel 18. The outer surface of web 18A forms either a finished surface or a surface to which customer-supplied finishing materials may be applied.

Ledgers 19 are formed in a similar manner to rim tracks 18, each ledger having a web 19A and a pair of flanges 19B. Additionally, ledger 19 includes openings 19C for receiving fasteners, such as lag bolts, to secure the ledger to band 2, for example. See FIG. 2. In one embodiment the height of web 19A is typically sufficient to allow ends of joists 14 to be received between flanges 19B.

Figure 5B:
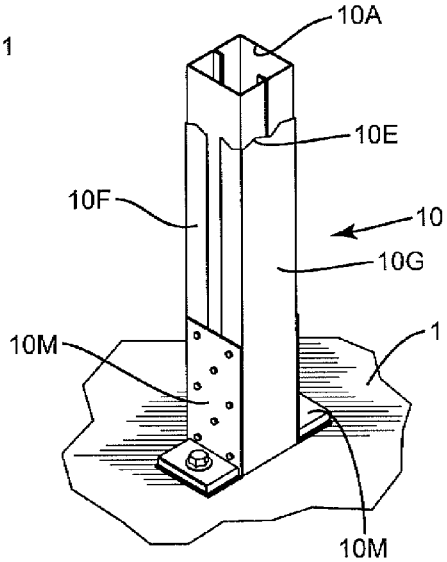
FIG. 5B is fragmentary perspective view of a support post.

Support posts 10 and girders 12 form at least a portion of the support structure for platform 210 as illustrated in FIG. 2. FIGS. 5A and 5B illustrate one embodiment of support post 10 and alternate embodiments for securing support the post to footing 1. Considering support post 10 itself, the support post may be formed from a pair of inner support post channels 10A, each having an inner web 10B with a pair of flanges 10C extending the web. A lip 10D extends along an edge of each flange 10C. Each channel 10A is disposed opposite the other channel so that the respective lips 10D abut each other. The pair of inner channels 10A is held together by a pair of outer channels 10E that partially surround the inner channels. Each channel 10E includes a pair of flanges 10F extending from a web 10G. Pair of inner channels 10A is generally encased within pair of outer channels 10E, web 10G lying adjacent flanges 10F and flanges 10C extending adjacent webs 10B. Screws are provided to secure outer channels 10E to inner channels 10A.

To facilitate adjustments in the height of support posts 10 channels 10E may be segmented into upper and lower segments. In one embodiment, one of the segments may be telescoped along the support post 10 to adjust the height of the post. The movable segment may be secured at various positions by screws or other fasteners inserted through openings in web 10G. See FIG. 5A.

In one embodiment, a base adapter 10K is secured to footing 1 using an anchor bolt. Upturned base tabs 10N are provided on base adapter 10K for support post 10 to be placed over the base tabs and secured thereto by screws or other fasteners (not shown). An alternate embodiment, illustrated in FIG. 5B, includes a pair of base angle brackets 10M for securing post 10 to footing 1. To secure girder 12 to post 10, one or more girder mounting clips 10P are provided. Clips 10P are configured with openings to permit securing each clip between post 10 and girder 12. One or more posts 10 may directly support portions of platform 210 by being secured in a similar fashion to a joist 14.

Turning now to girders 12, in one embodiment each girder is formed utilizing a pair of inner girder channels 12A as illustrated in FIG. 5A. Each inner channel 12A includes a web 12B and a pair of flanges 12C extending from the web. Each flange 12C is generally parallel to the other flange in the pair and generally perpendicular to web 12B. Each flange 12C also includes a lip 12D bent at an angle, typically about 90 degrees, relative to the flange and extending along an edge of the flange. Pair of channels 12A are disposed back-to-back such that the respective webs 12A abut. This combination of channels 12A can be considered to form an "I-beam" section.

At selected locations along girder 12, where the girder is intended to rest upon one of the support posts 10, a pair of channel-type web stiffeners 30 is disposed between flanges 12C. In the embodiment, illustrated in FIG. 5A, web stiffener 30 comprises a web 32 and a pair of flanges 34 extending from the web. Each flange 34 includes a lip 34A bent at an angle, typically about 90 degrees, relative to the flange. In one embodiment, web stiffener 30 may be oriented such that when the stiffener is installed flanges 34 are generally perpendicular to a longitudinal axis of girder 12. Web stiffeners 30 are adapted to be secured to girder 12 by means of screws or other fasteners extending through the webs 32 and 12B. Web stiffeners 30 may be provided also for use in association with stiffening joists 14 or other components.

In one embodiment, girder 12 further includes a pair of outer channels 12E partially encasing or surrounding inner channels 12A. Each outer channel 12E comprises a web 12F and a pair of flanges 12G. Each outer channel 12E is disposed adjacent an inner channel 12A such that web 12F faces web 12B and flanges 12G lie adjacent flanges 12C. A portion of web 12F abuts lips 12D. Outer channels 12E may be secured to inner channels 12A by means of screws or other fasteners passing through flanges 12G and 12C. This embodiment of girder 12 is in the form of a "box beam" reinforced with an interior "I-beam".

Figure 9A:
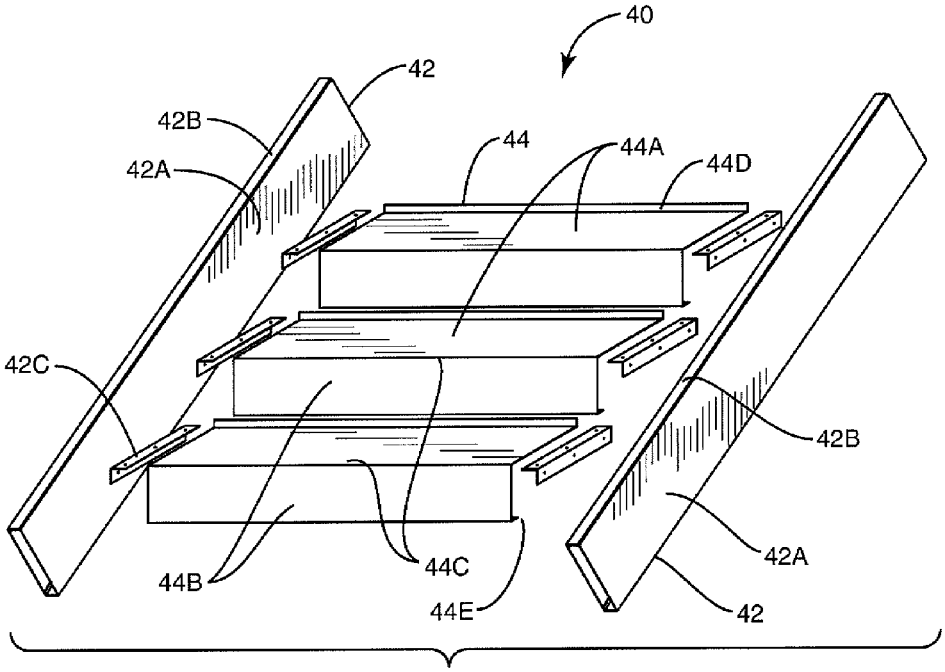
FIG. 9A is an exploded perspective view of a set of stairs.
Figure 9B:
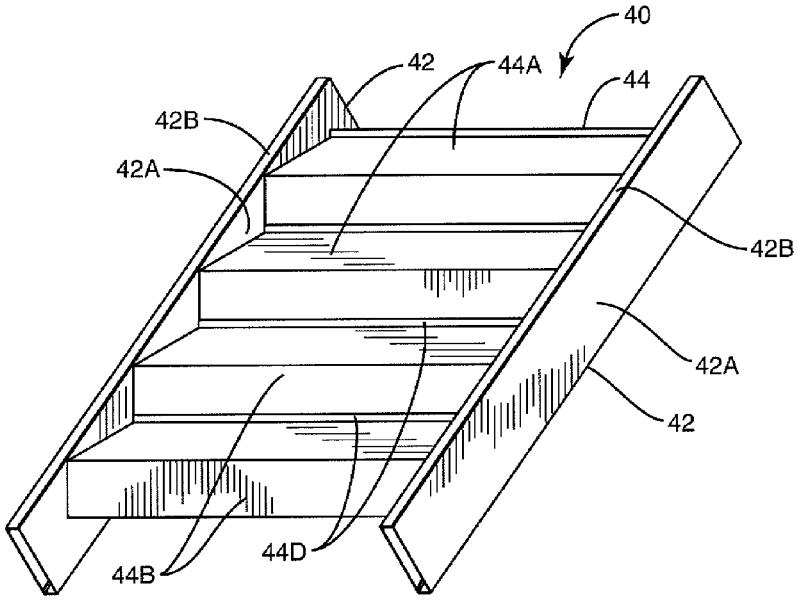
FIG. 9B is a perspective view of a set of stairs.

Kit 100 may also include a set of metal stairs 40. See FIGS. 9A and 9B. Each set of stairs includes a pair of stringers 42 and a series of tread pans 44. In one embodiment, each stringer 42 is formed as a box section or box beam having webs 42A and 42B. Disposed on or formed in the outer surface of one of the webs 42A of each stringer 42 is a series of spaced-apart support cleats 42C oriented to receive ends of tread pans 44. In one embodiment, support cleats 42C comprise angle brackets secured with screws to one of the webs 42B. Each stringer 42 in the pair, with support cleats 42C incorporated therewith, is a mirror image of the other stringer. Each tread pan 44 comprises, in one embodiment, a bent or formed sheet of metal having a tread section 44A and a riser section 44B formed by bending the sheet to form an edge 44C. Tread section 44A generally assumes an angle of approximately 90 degrees relative to riser section 44B. Opposite edge 44C is formed a tread lip 44D extending generally upward from tread section 44A at about 90 degrees relative to the tread section. Similarly, opposite edge 44C and extending from riser section 44B is a riser lip 44E extending generally rearward at approximately 90 degrees relative to the riser section.

If required by building safety codes or otherwise desired, kit 100 may include one or more handrail posts 20. See FIGS. 8A and 8B. Together with a composite sleeve 28, which may be decorative, and handrail post brackets 29, one of the handrail posts 20 may be used for forming a post assembly to support a handrail. A plurality of post assemblies may be disposed about one or more portions of platform 210, along stringers 42 of sets of stairs 40, or anywhere on deck 200 where a handrail is desired or required. In one embodiment, post 20 forms a box column section 22 illustrated in FIGS. 8A and 8B. Box column section 22 is formed with first and second overlapping elongated angled sections 24 and 26. First elongated section 24 includes a pair of flanges 24A disposed at approximately 90 degrees relative to each other. Each flange 24A includes a tab 24B extending from the flange at about 90 degrees such that, when viewed from the an end of handrail post 20, angle section 24 forms a box with one corner omitted. Second angle section 26 comprises a pair of flanges 26A disposed at about 90 degrees relative to each other. Second section 26 is disposed adjacent first section 24 such that flanges 26A extend adjacent tabs 24B in such a manner that section 26 closes, or fills in, the omitted corner of first section 24. Screws are provided to secure sections 24 and 26 together. Sleeve 28 is generally formed of a non-metallic material such that box section 22 may extend within the sleeve to form a post assembly.

FIG. 1A shows various components of kit 100. A particular kit 100, when formed for a customer, may include various numbers of each element according to a layout plan or design that is available for the particular deck 200 to be erected. Moreover, not all of the components may appear in each and every kit 100. For example, where a customer does not desire a handrail assembly, no handrail posts 20, brackets 29 and sleeves 28 are included in the kit. In general, a kit 100 can be provided to contain the selection and numbers of components from among those depicted in FIG. 1A and described herein as required for the erection of a particular deck 200.

Turning now to the utilization of kit 100 for erecting deck 200, it is appreciated that the process of erecting the deck is typically guided by a layout or design plan, mentioned above, that is produced specific to the particular installation. Such a design or layout plan can be produced by a person of ordinary skill in light metal building design. The plan specifies the shape of platform 210, and the number and placement of footings 1, support posts 10, girders 12, and ledgers 19 needed to form a support structure for the platform. The plan further specifies the numbers and lengths of joists 14 and the required spacing to be maintained along with required bridging elements 16 and the locations where the bridging elements are to be installed. The plan also may include the number of sets of stairs 40 and their respective placements. The plan should further include an indication of any required or desired handrails and the corresponding placement of handrail posts 20. The plan may specify any customer-supplied decking and trim materials to be applied to deck 200 upon erection.

Generally, erection of deck 200 includes first forming a support structure for platform 210. After forming the support structure, platform 210 is assembled and secured to the support structure. Any required or desired handrail posts 20 are then connected to platform 210 and one or more sets of stairs are assembled and secured to the platform. Customer-supplied decking and trim materials may then be applied to deck 200.

The support structure for platform 210 generally comprises a group of footings 1, support posts 20, and one or more girders 12 as noted here before. Where the plan calls for platform 210 to be secured to the appurtenant residential structure 300, the support structure may also include one or more ledgers 19 secured to residential structure 300. To form the support structure, footings 1 are appropriately placed relative to residential structure 300 in accordance with the design or layout plan. Footings 1 may be of any of various types known to those of ordinary skill in construction. In one case, for example, concrete footings 1 that are poured into excavations may be used. In another case, footings 1 may comprise pre-formed concrete or masonry footing units, and may be implanted in or on the ground as prescribed by the plan. Provision is made for securing support posts 10 to footings 1 by, for example, embedding masonry anchors to receive anchor bolts. Generally, one of the support posts 10 is erected on and secured to each footing 1. See FIGS. 5A and 5B. In one embodiment, a base adapter 10K may be secured to footing 1 using an anchor bolt. Support post 10 is then placed over upturned tabs 10N and the post is secured to the tab with screws or other fasteners (not shown). In one embodiment, a pair of base angle brackets 10M is secured with screws to support post 20. Angle brackets 10M are secured to footing 1 with anchor bolts.

After erecting and securing support posts 10, the height of each support post may be adjusted for leveling purposes. In one embodiment, upper segments of outer channels 10E may be slid along inner channels 10A to adjust the height of support post 10. Upper segments of outer channels 10E may then be secured to inner channels 10A using screws or other fasteners. As provided in the layout or design plan, girders 12 are then placed atop support posts 10, each girder generally spanning at least two posts. Girders 12 are secured to the posts 10 using girder mounting clips 10P and screws. Where platform 210 is to be partially supported by residential structure 300, one or more ledgers 19 may be secured to appropriate structural elements, such as band 2, of the residential structure as illustrated in FIG. 2. Ledger 19 may be secured using lag bolts inserted through openings in web 19A and seated into band 2. See FIG. 2. Ends of joists 14 are received by ledger 19 and secured thereto during assembly of platform 210 as further described below.

The heretofore described erection of one embodiment of the support structure for platform 210 includes one or more girders 12 disposed generally parallel to a portion of residential structure 300, each supported independently of the residential structure by two or more support posts 10. Alternative layouts could be employed. For example, one or more girders 12 could be oriented perpendicularly to the a portion of residential structure 300 and partially supported by the residential structure and one or more support posts 10.

Figure 10:
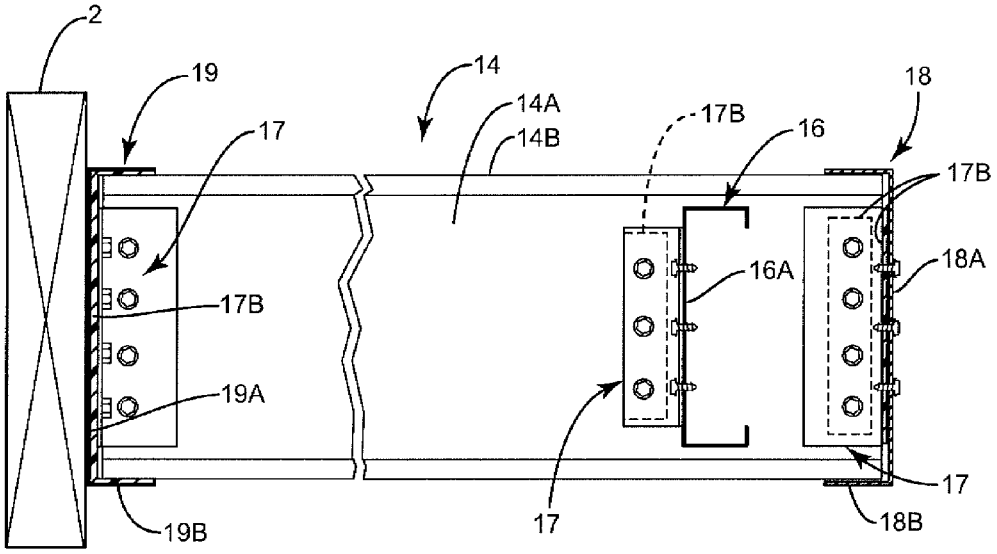
FIG. 10 is a fragmentary side cross-sectional view of a joist showing shock or vibration absorber pads incorporated with connectors securing the joist to a rim track and a ledger, and securing a bridging element to the joist.

The support structure for platform 210 having been thus erected, the required array of joists 14 may be cut as needed and placed in appropriate spacing across the girders 12 to form the platform. Typically, joists 14 are extended across girders 12 in a direction generally perpendicular to the girders. However, joists 14 may be laid at other angles crossing the girders 12 as may be provided in the plan. The actual spacing between adjacent joists 14 is dependent on specifications in the design or layout plan. Typical spacings include 16 and 24 inches on center. Ends of some joists 14 may be inserted into and connected to any ledgers 19 that are included in the support structure. Bridging elements 16 are applied as required, typically between adjacent joists 14. In one embodiment, connectors 17 are secured between webs 16A and 14A to secure bridging elements 16 as shown in FIG. 4. In one embodiment, web stiffeners 31 are utilized to connect joists 14 to ledger 19, for example, as shown in FIG. 2. When installing one of the connectors 17, a vibration absorbing pad 17A may be interposed between the connector and each of webs 14A and 16A. Screws or other suitable fasteners may be used to secure connectors 17, and any pads 17A, to webs 14A and 16A. In order to stiffen joists 14 to resist crushing due to concentrated loads such as might occur in the vicinity of where each joist crosses and rests upon girder 12, a web stiffener 30 or 31 may be installed. To secure web stiffener 31 to joist 14, the web stiffener is oriented such that a longitudinal axis thereof is generally vertical, and one of the flanges 33 or 35 (FIG. 6) is extended adjacent web 14A. Screws are then inserted into openings 31C in flange 33 or 35 and seated into web 14A. A screw may also be inserted through one of the openings 31C in main tab 37 and seated into girder 12 thereby securing joist 14 to the girder. Vibration absorbing pads 17B may be interposed between flange 33 or 35 and web 14A as well as between main tab 37 and girder 12 before inserting and seating screws. In one embodiment, one of the web stiffeners 30 may be secured to web 14A as shown in FIG. 3. To secure web stiffener 30, the stiffener is oriented such that flanges 34 are generally vertical. Web 32 is extended along web 14A, and the webs are secured together using screws. In this embodiment, joist 14 is secured to girder 12 by means of one or more screws connecting the flange 14B that rests directly on the girder to the girder (not shown). Where "Z" section joists 14 are used, the web stiffeners would generally be applied to the side of web 14A opposite the flange 14B that rests directly on girder 12.

Where one or more joists 14 is inserted into any ledger 19 mounted on the residential structure 300, web 14A may be secured to web 19A with a web stiffener 31 along with, if desired, vibration pad 17B using screws as shown in FIG. 2 and in a similar manner as described before for applying the stiffener to a joist over a girder 12. Alternatively, a connector 17 and vibration pads 17B may be used to secure web 14A to web 19A as illustrated in FIG. 10.

One or more rim tracks 18 are installed to complete platform 210. Rim tracks 18 are positioned along the outer periphery of platform 210 and secured to joists 14 as shown in FIG. 4. In some cases, the plan may call for cut-outs or openings inside the perimeter of platform 210. In such cases, rim tracks 18 may be applied to the exposed joists 14 around the edges of such openings. One of the joists 14 is secured to one of the rim tracks 18 by connecting webs 14A and 18A by any of several methods including those described before for securing bridging elements 16 and joists 14 together, for example. In particular, web 14A may be secured to web 18A with one of the connectors 17 and vibration absorbing pads as illustrated in FIG. 10. Alternatively, the joist-rim track securement may be made using one of the web stiffeners 31 in a manner similar to the earlier described connection of joist 14 to ledger 19. Vibration absorbing pads 17B may also be used in making this alternative securement. Two sections of rim track 18 may require being joined end-to-end where, for example, there is a need to piece a rim track or at a corner of platform 210. Connections between such rim track sections may be made using connectors 17 as shown in FIG. 4.

Platform 210 having been completed, one or more sets of stairs 40 (FIGS. 9, 9A) may be installed. Stringers 42 may be cut to length with end angles appropriate for installation in a manner known to those of ordinary skill in metal frame construction. Each stringer 42 is positioned such that the topmost support cleat 42C is disposed at the appropriate rise distance below the top of platform 210. Stringers 42 may be secured to one of the rim tracks 18 using any of various commonly known methods of connection, including those methods heretofore described for securing various components of deck 200 together. The lower ends of stringers 42 are conventionally supported on and anchored to the ground or patio or other foundation or footing provided. Tread pans 44 may be installed by orienting each pan horizontally and generally perpendicular to stringers 42 and placing opposite ends of the pans on opposed support cleats 42C so that the tread pans are suspended between the pair of stringers. In particular, one tread pan 44 is placed on the topmost pair of opposed support cleats 42C such that riser lip 44D abuts web 18A of rim track 18. Tread pan 44 is secured using screws or other fasteners to support cleats 42C. Another tread pan 44 is placed on the next pair of support cleats 42C such that riser lip 44D of that tread pan abuts a lower portion of riser section 44B of the already installed tread pan. This process is continued to install all required tread pans 44 and complete the assembly of set of stairs 40.

Figure 8A:
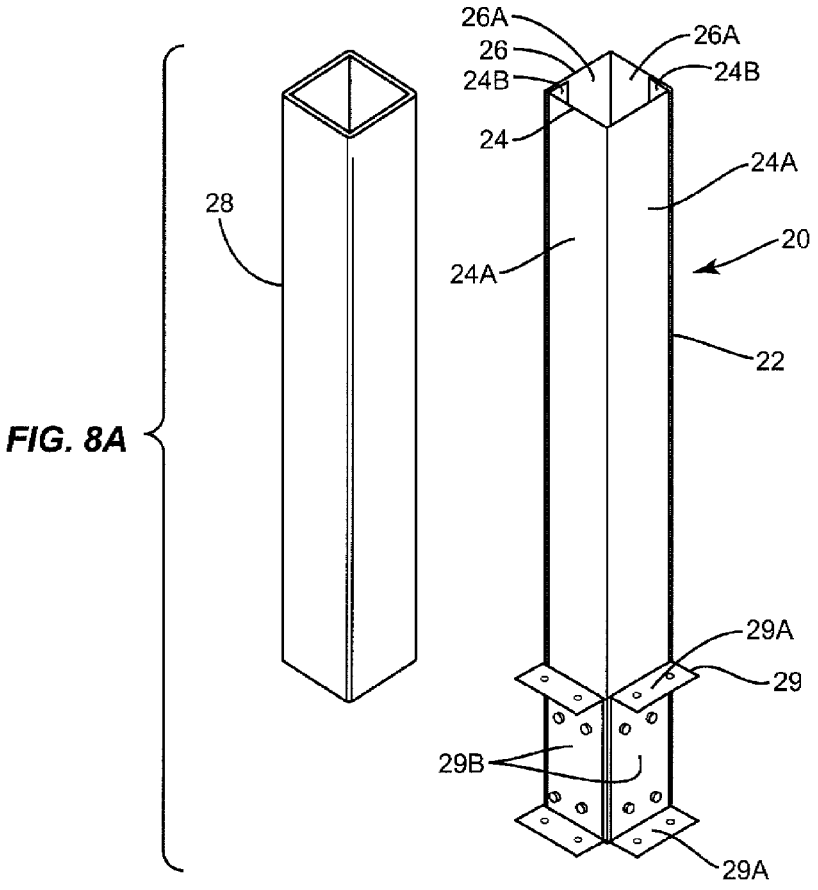
FIG. 8A is a perspective view of a handrail post and sleeve.
Figure 8B:
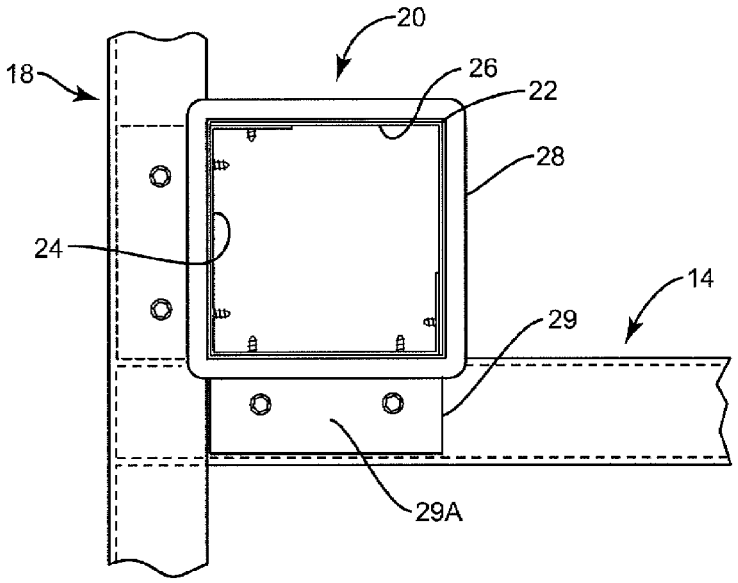
FIG. 8B is a fragmentary plan view of a handrail post installed in the platform.

Handrail posts 20 as desired or required may be secured at appropriate locations on platform 210 as illustrated in FIGS. 4, 8A, and 8B. Generally, each handrail post 20 is installed at an intersection between structural elements of platform 210. For example, handrail post 20 may be installed where one of the joists 14 connects to one of the rim tracks 18 as shown in FIG. 4. As shown in FIG. 8A, a pair of handrail post brackets 29 may be secured with screws to adjacent sides of a lower portion of handrail post 20. Flanges 29A extend above and below flanges 18A of rim track 18 and flanges 14A of joist 14. Flanges 29A are secured to respective flanges 18A and 14A using screws. If desired, handrail posts 20 may be secured to stringers 42 by any of various known methods. A sleeve 28 may be placed over each handrail post 20 such the post extends within the sleeve and is generally concealed therein. Handrails of any desired customer-supplied materials may be supported on and secured to handrail posts 20 by commonly known methods.

Figure 9C:
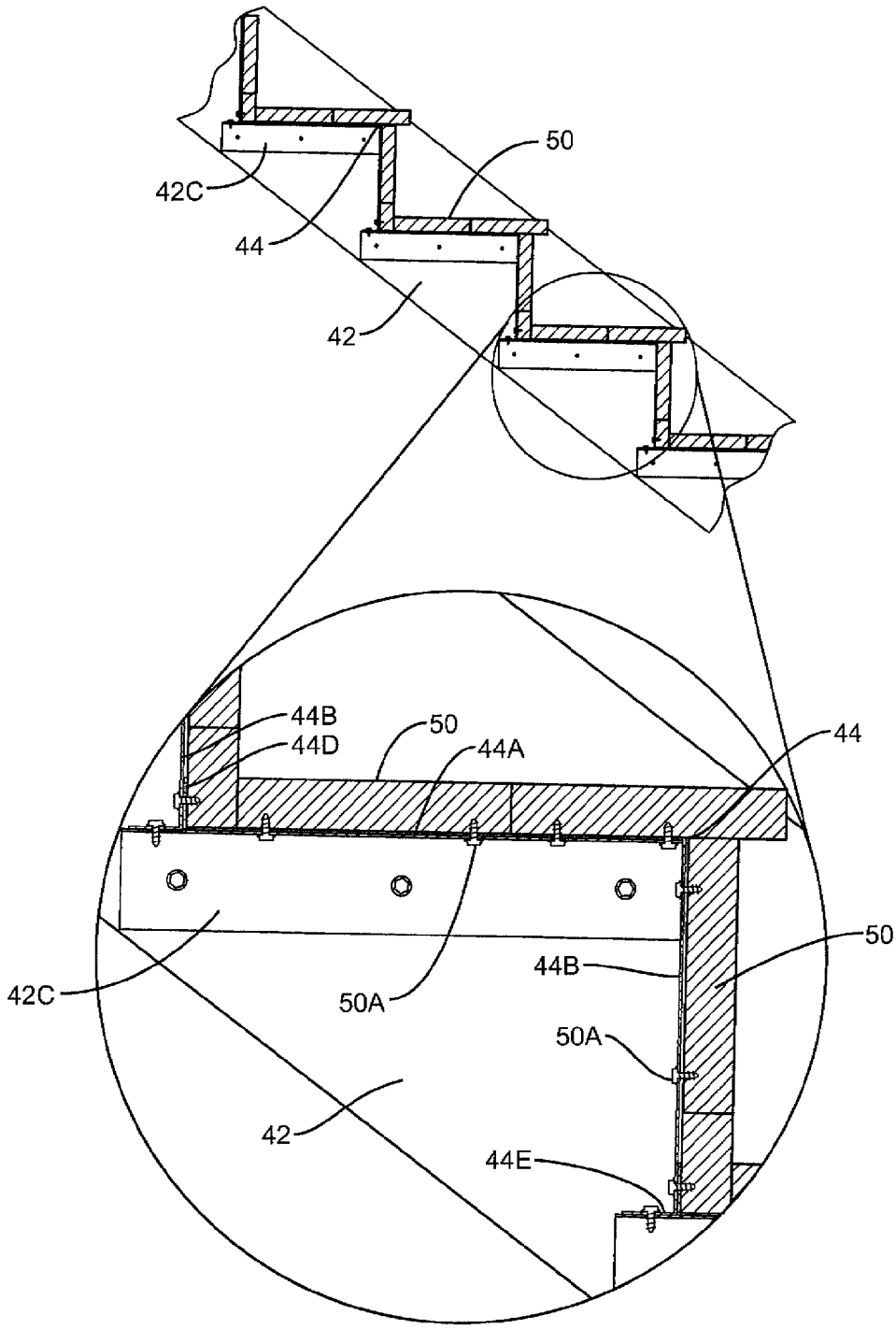
FIG. 9C is a side cross-sectional view with inset showing non-metallic treads and risers installed on a tread pan.

The erection of deck 200 having been completed, customer-supplied planking or decking 50 along with any customer-supplied trim materials and railings may be applied to the deck. Decking 50 is generally available in the form of elongated planks, and usually a non-metallic material is utilized. In particular, with regard to the application of decking 50 to platform 210, the present invention provides methods for securing the planking or decking to the platform. Referring to FIGS. 7A and 7B, it is appreciated that decking 50 may be laid on the upper of flanges 14A of joists 14. Decking may be extended across joists 14 generally perpendicularly to the joists, or the decking may be laid on a bias according to the plan for deck 200. Adjacent decking or planks 50 are typically closely, but not tightly spaced. The lower surfaces of decking 50 are in contact with upper flanges 14A. Screws 50A may be inserted from underneath the upper flanges 14A through openings 14D, piercing the lower surfaces of decking 50 and seating into the decking without penetrating the upper surface of the decking. This installation provides a smooth and intact upper surface for the decking. FIG. 9C illustrates this method as applied to installing planks as finish risers and treads to tread pans 44. It is noted that decking screws 50A are driven from the back side of riser section 44B through the riser section and into the finished riser, for example. This method of attachment may be used to secure various forms of decking and trim including composite or wooden decking planks, trim boards, treads and risers to provide smooth and intact exposed surfaces thereof.

The term "girder" means a load bearing elongated structure that is horizontally oriented and which supports a horizontal floor or a horizontal platform and which is itself supported at a plurality of points by, for example, columns or posts. The term "joists" means a series of spaced apart and horizontally disposed load bearing structures that support a floor such as decking planks. The term "rim track" means a metal structure that extends around the perimeter of a platform or floor structure that supports decking material such as decking planks. The term "tread pan" as used herein means one piece of metal that forms a part of a stair structure and includes a riser section and a tread section with the riser and tread sections being disposed at an angle of approximately 90° to each other. The term "web stiffener" as used herein means a structural member that is designed and intended to be used by securing the same to the web of an elongated metal member.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A metal deck kit for erecting a metal deck appurtenant a residential structure, comprising:

a. a platform including a plurality of metal joists, one or more metal rim tracks, and a plurality of metal connectors, the platform configured to receive decking;

b. one or more metal girders for supporting the platform;

c. one or more metal support posts adapted to be secured to the girders or to the platform for supporting the platform;

d. one or more sets of metal stairs for connecting to the platform and for providing ingress and egress from the deck; and e. at least one web stiffener comprising an elongated metal plate bent about a longitudinal axis to form first and second elongated flanges having an angle there between, wherein the first elongated flange includes a main tab extending from an end thereof and bent about a transverse axis at an angle with respect to the first elongated flange, and wherein the main tab includes a secondary tab extending from an edge of the main tab, the secondary tab being bent at an angle such that the secondary tab extends adjacent a portion of the second elongated flange.

2. The kit of claim 1 wherein one of the support posts comprises:

a. a first pair of elongated channels, each channel including a first web and a first pair of flanges each extending in the same direction at about 90 degrees relative to the first web, the first pair of channels disposed adjacent one another such that the channels form an elongated box with open ends and having a first pair of opposed sides formed by the first webs and a second pair of opposed sides generally orthogonal to the first pair of opposed sides and formed by one of the flanges of one of the-elongated channels and one of the flanges of the other elongated channel;

b. a second pair of elongated channels, each channel including a second web and a second pair of flanges each extending in the same direction at about 90 degrees relative to the second web;

c. the second pair of elongated channels generally encasing and extending adjacent the first pair of elongated channels.

3. The kit of claim 2 wherein the second pair of elongated channels is divided into two channel sections that are elongated, each section separated by a space from the other section, at least one section movable with respect to the other section enabling the height of the support post to be adjusted.

4. The kit of claim 1 wherein each girder includes:

a. a pair of inner channels with each inner channel having a web and a pair of flanges;

b. the webs of the inner channels being disposed in back-to-back relationship such that the inner channels form an I-beam;

c. a pair of outer channels with each outer channel having a web and a pair of flanges;

d. the pair of outer channels at least partially enclosing the inner channels with the flanges of the outer channels at least partially overlapping and disposed adjacent the flanges of the inner channels; and e. wherein the outer channels form a box beam that generally encloses the formed I-beam.

5. The kit of claim 1 including a metal handrail assembly comprising one or more handrail posts and one or more sleeves adapted for encasing the posts.

6. The kit of claim 1 including one or more handrail posts wherein each handrail post comprises an elongated box column formed from first and second elongated sections, the first section comprising a first pair of first flanges disposed at about 90 degrees relative to each other with each flange having a tab disposed along an edge of the flange and disposed at an angle of about 90 degrees relative to the flange, the second section comprising a second pair of flanges disposed at about 90 degrees relative to each other, and the first and second sections disposed adjacent one another such that each flange of the second pair of flanges extends adjacent a flange of the first pair of flanges and the first and second pair of flanges together form the elongated box column.

7. The kit of claim 1 including a series of stiffening ribs formed within one or more of the first and second elongated flanges, the main tab, and the secondary tab.

8. The kit of claim 7 wherein a first group of stiffening ribs is disposed on the secondary tab and a second group of ribs is disposed on the second flange, and wherein one or more of the stiffening ribs disposed on the secondary tab engages one or more of the stiffening ribs on the second flange for securing the secondary tab against the second flange.

9. The kit of claim 1 wherein each set of stairs includes a pair of stringers and a series of tread pans; and wherein each tread pan comprises an elongate folded panel including a riser section and a tread section, the riser section being disposed at approximately a 90 degree angle relative to the tread section.

10. The kit of claim 1 wherein a plurality of the metal joists that form a part of the platform include an upper flange, and wherein there is provided an array of pre-punched holes formed in the upper flanges to enable planks or decking to be secured by fasteners to the joists.

11. The kit of claim 1 including one or more handrail posts wherein at least one of the handrail posts comprises an elongated box section and a decorative sleeve disposed over the box section.

12. The kit of claim 1 including a plurality of connectors for connecting various components of the kit together, and wherein one or more connectors includes a shock absorbing pad adapted to be disposed between a portion of the connector and a component of the kit.

13. The kit of claim 12 wherein the shock absorbing pad is formed from a non-flammable material.

14. The kit of claim 1 including fasteners for securing the decking to upper disposed flanges of the joists, and wherein when the metal deck is erected, the fasteners project upwardly through the upper flanges of the joists and into and through undersides of the decking without penetrating an upper surface of the decking.

15. A metal deck kit for erecting a metal deck appurtenant a residential structure, comprising:

a. a platform including a plurality of metal joists, one or more metal rim tracks, and a plurality of metal connectors, the platform configured to receive decking;

b. one or more metal girders for supporting the platform;

c. one or more metal support posts adapted to be secured to the girders or to the platform for supporting the platform; and d. a set of metal stairs for connecting to the platform for providing ingress and egress from the deck, the set of stairs including:

i. a series of tread pans and a pair of stringers supporting the tread pans, ii. each tread pan comprising an elongated sheet metal plate bent about a longitudinal axis at approximately 90° to form a tread section and a riser section, iii. a riser lip formed along a longitudinal edge of the riser section, iv. a tread lip formed along a longitudinal edge of the tread section, wherein the tread lip of one of the tread pans abuts the riser section of an adjacent tread pan on a face of the riser section; and wherein at least one of the stringers is formed as a box beam having side faces or webs and wherein one of the side faces or webs is configured to connect with the tread pans.

16. The kit of claim 15 wherein the set of stairs includes one or more clips wherein each clip comprises an elongated bent plate having two elongated and mutually orthogonal flanges and wherein one flange of each clip is secured to an end of a tread pan and the other flange is secured to a supporting structure or to one of the faces of one of the stringers.

17. A metal deck kit for erecting a metal deck appurtenant a residential structure, comprising:

a. a platform including a plurality of metal joists, one or more metal rim tracks, and a plurality of metal connectors, the platform configured to receive decking;

b. one or more metal girders for supporting the platform;

c. one or more metal support posts adapted to be secured to the girders or to the platform for supporting the platform;

d. one or more sets of metal stairs for connecting to the platform and for providing ingress and egress from the deck; and e. a plurality of connectors for connecting various components of the kit together, and wherein one or more connectors includes a shock absorbing pad adapted to be disposed between a portion of the connector and a component of the kit.

* * * * *